United States Patent [19]

Imerman et al.

[11] 4,446,976

[45] May 8, 1984

[54] REVERSIBLE OUTRIGGER CRANE SUPPORT

[75] Inventors: Curtis E. Imerman, Cedar Rapids; David S. Langerud, Solon; Brian H. Thomas, Cedar Rapids, all of Iowa

[73] Assignee: FMC Corporation, Chicago, Ill.

[21] Appl. No.: 349,100

[22] Filed: Feb. 16, 1982

[51] Int. Cl.[3] ..... B66C 23/72

[52] U.S. Cl. ..... 212/189; 212/175

[58] Field of Search ..... 212/189, 175, 178, 179; 280/763, 764, 765, 766, 767

[56] References Cited

U.S. PATENT DOCUMENTS

| | | | |
|---|---|---|---|
| 2,985,318 | 5/1961 | Nickles et al. | 212/189 |
| 3,023,913 | 3/1962 | Talbert | 212/189 |
| 3,840,125 | 10/1974 | Cozad | 212/189 |
| 3,878,944 | 4/1975 | Beduhn et al. | 212/189 |
| 4,266,809 | 5/1981 | Wuerflein | 280/766 |
| 4,273,244 | 6/1981 | Jensen et al. | 212/189 |

*Primary Examiner*—Trygve M. Blix
*Assistant Examiner*—Thomas J. Brahan
*Attorney, Agent, or Firm*—A. J. Moore; R. B. Megley

[57] ABSTRACT

A basic crane capable of lifting a predetermined load is equipped with an outrigger unit which, in one orientation, engages the ground to increase the lifting capacity of the crane to an intermediate level and, in a second orientation relative to the crane, is arranged to coact with members of heavy duty equipment which may be added to the basic crane to give it a heavy duty lifting capacity.

5 Claims, 9 Drawing Figures

FIG_5
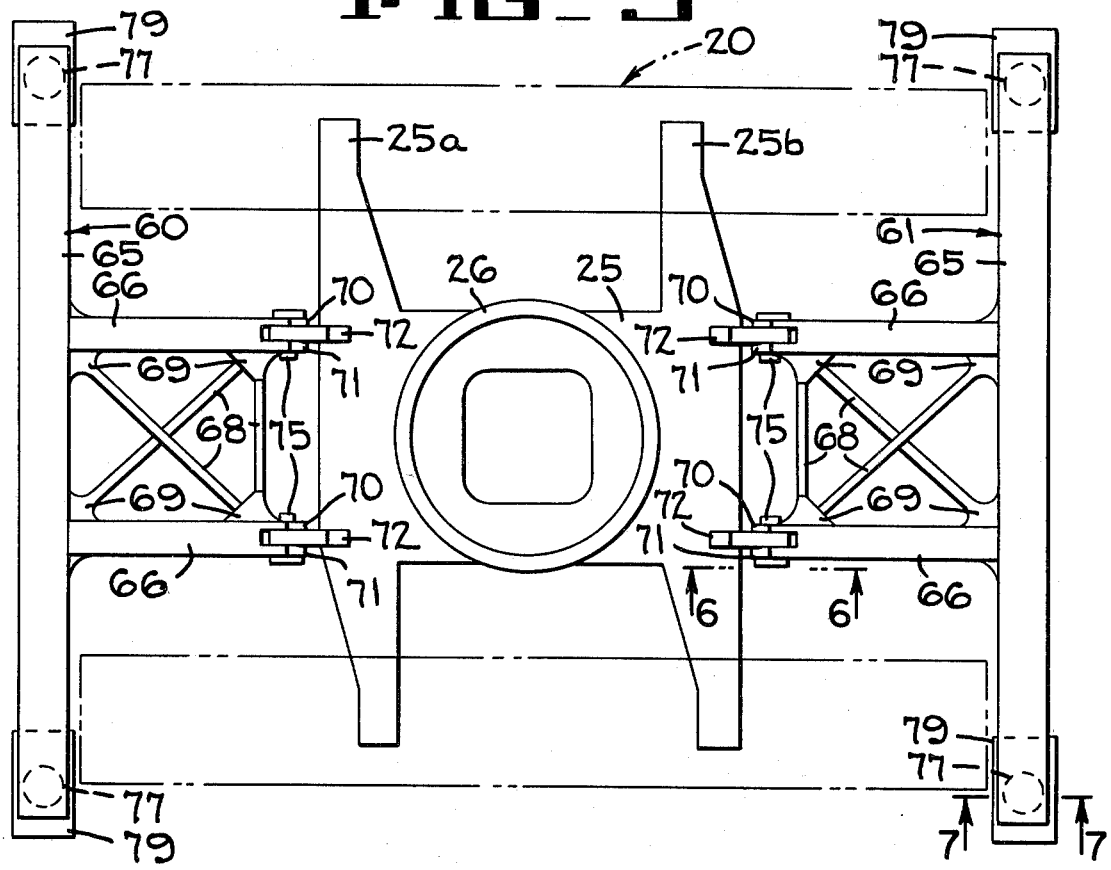
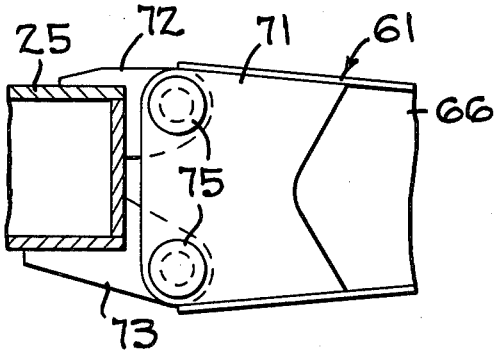
FIG_6
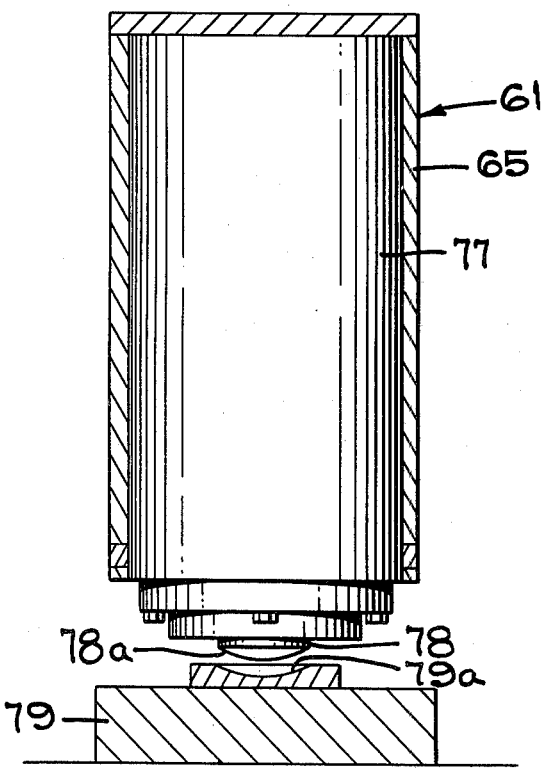
FIG_7

REVERSIBLE OUTRIGGER CRANE SUPPORT

CROSS REFERENCE TO RELATED APPLICATIONS

The present application relates to U.S. application Ser. No. 138,461 to Wittman et al. filed on Apr. 8, 1980 and issued as U.S. Pat. No. 4,394,911 on July 26, 1983. This patent is assigned to the assignee of the present invention.

BACKGROUND OF THE INVENTION

1. Field of the Invention

The present invention relates to cranes and more particularly relates to reversible outrigger supports for varying the lifting capacity of the crane depending upon the orientation of the outrigger supports.

2. Description of the Prior Art

The use of outriggers to provide stability to a crane or similar machine is well known. Also, power-operated ground-engaging jacks have been used at the outer end of outrigger arms.

Cranes that are used in heavy construction work are fairly large units and the movement of such members from job site to job site is difficult and expensive. It is therefore desirable that a single crane be capable of a fairly large range of lifting capacities so that additional cranes need not be brought to the site to take care of lifting operations beyond the range of the basic crane on the job. Also, of course, since cranes are expensive, they must be used frequently to justify their original purchase. An object of the present invention is to provide a crane capable of operating in several load ranges.

The use of outriggers to give added lifting stability to cranes is, of course, well known, as also is the use of power jacks mounted in the outer ends of the arms. Thus, at present, the lifting range of a basic crane at a job site can be increased somewhat by the attachment of outriggers. In accordance with the present invention, even further increases in the lifting capacity of a basic crane can be obtained by the use of outrigger units, not only to engage the ground to provide the above-mentioned increase in lifting capacity, but also to coact with members of heavy-duty attachments to make them operable with a basic crane and provide a heavy duty range of lifting capacity. In one type of heavy duty crane, an auxiliary frame is mounted on a basic crane and includes lifting members for raising the frame off the ground when the crane is moved from place to place. In the present invention, outrigger units carry out this auxiliary frame lifting function.

SUMMARY OF THE INVENTION

A crane is provided with means for mounting outrigger units in one orientation to engage the ground and provide lifting capacity for the crane and in a second orientation to act as frame lifting members.

DESCRIPTION OF THE DRAWINGS

FIG. 5 is an enlarged view of a portion of FIG. 4.

FIG. 6 is an enlarged section taken along lines 6—6 of FIG. 5.

FIG. 7 is an enlarged section taken along line 7—7 of FIG. 5.

DESCRIPTION OF THE PREFERRED EMBODIMENT

Figure 1:
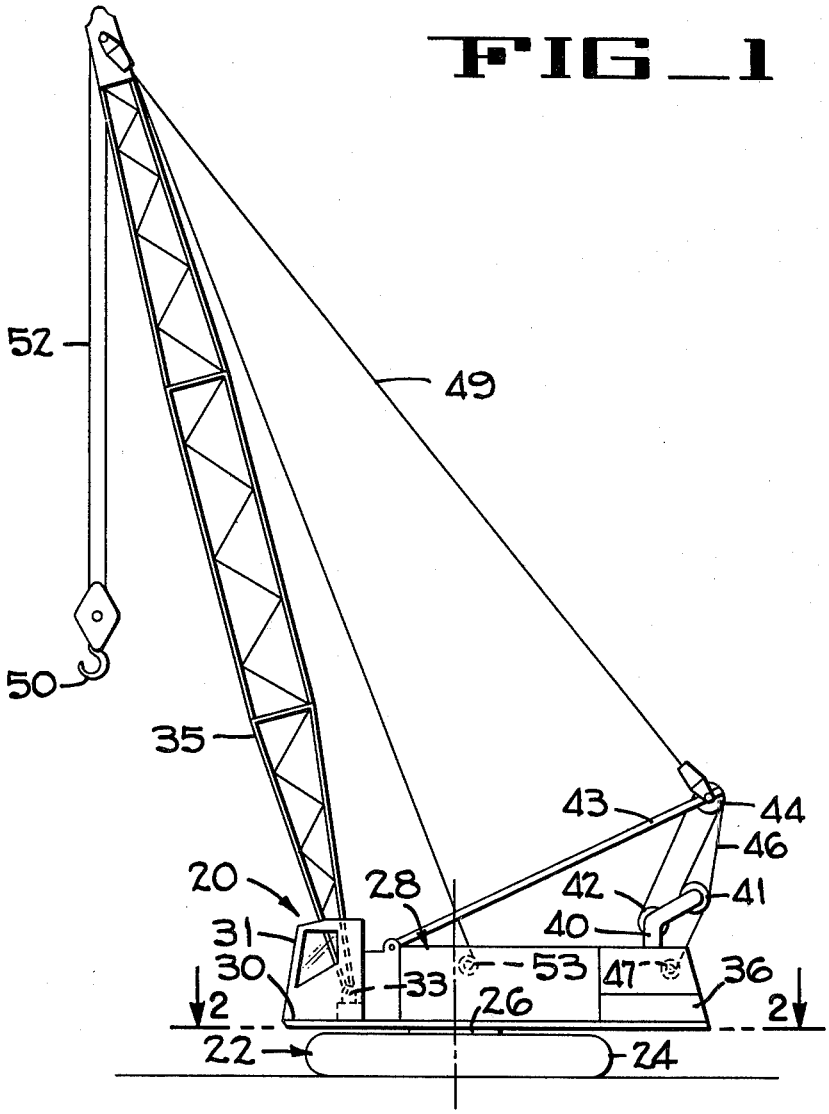
FIG. 1 is a diagramatic side elevation of the basic crane of the present invention.
Figure 2:
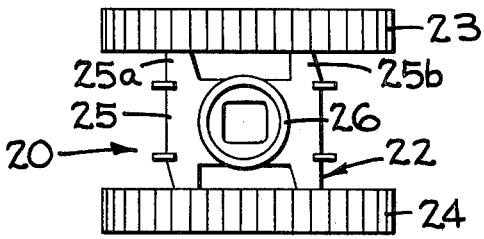
FIG. 2 is a diagrammatic plan view of the lower portion of the crane, the view being taken along line 2—2 of FIG. 1 with the upper members of the crane removed.

In FIGS. 1 and 2 the reference numeral 20 indicates the basic crane of the present invention which comprises a lower frame 22 having two spaced side sections on which power-driven endless chains 23 and 24 are mounted. The side sections are connected by a transverse body member 25 that has two axles 25*a* and 25*b* with end portions, that are generally square in cross-section, extending into square openings in the side sections of the lower frame. A bearing 26 supports an upper works section 28 of the crane for rotation about a vertical axis through the center of the bearing. The upper works includes a platform 30 supporting a control cab 31 and two sets of spaced mounting brackets 33 (one only being shown) that pivotally receive the lower end of a boom 35. The rear portion of the platform supports counterweights 36 and a bail assembly 40 that carries a fleeting sheave 41 and a plurality of guide sheaves 42. A live mast 43 is pivotally mounted on the upper works and carries a plurality of rotatable sheaves 44 near its outer end. Cables 46 extend from a powered hoist 47 around the fleeting sheave 41 and the sheaves 42 and 44. A pendant line 49 is anchored at one end to the end of the live mast 43 and at the other end to the outer end of the boom 35. A lifting hook 50 is supported by a cable 52 that is trained over sheaves in the outer end of the boom and is wound on a winch 53. This type of crane, when supported on the endless tracks 23, 24 has a lifting capacity of 400 tons.

Figure 3:
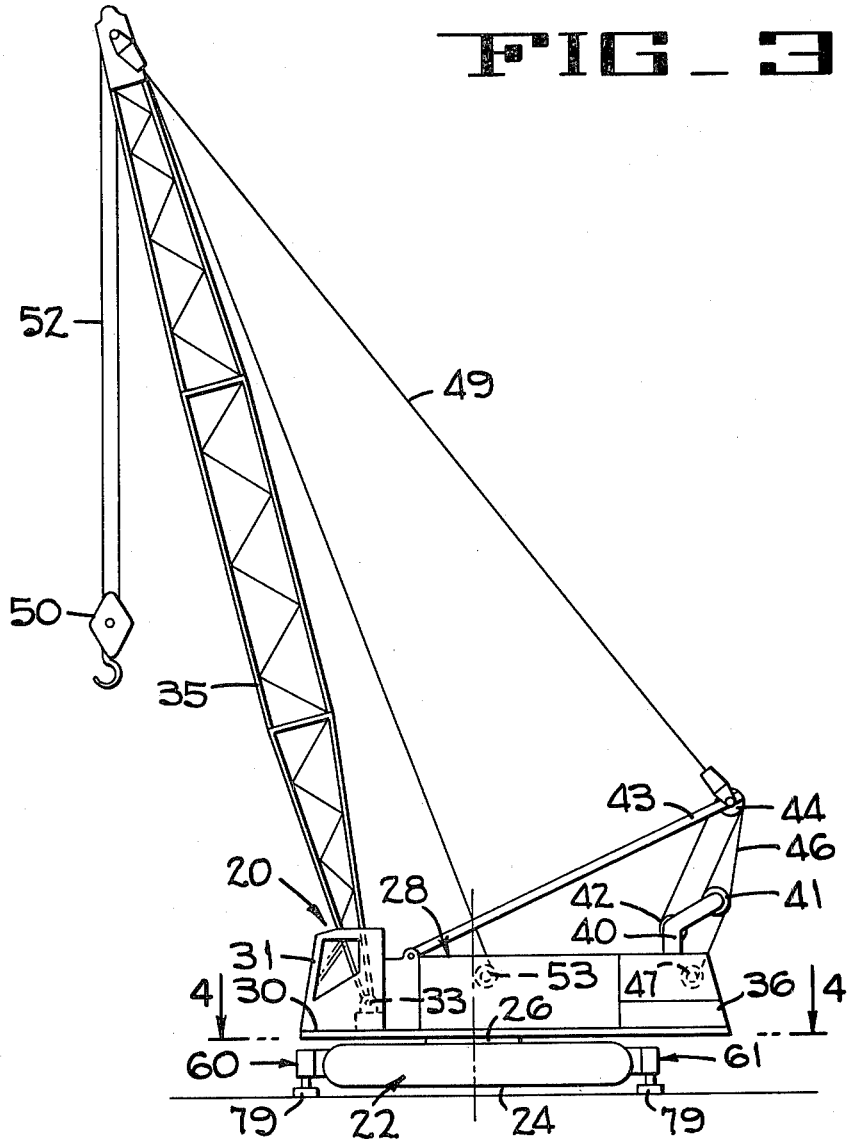
FIG. 3 is a diagrammatic side elevation of the crane of the present invention shown equipped with out-rigger units.
Figure 4:
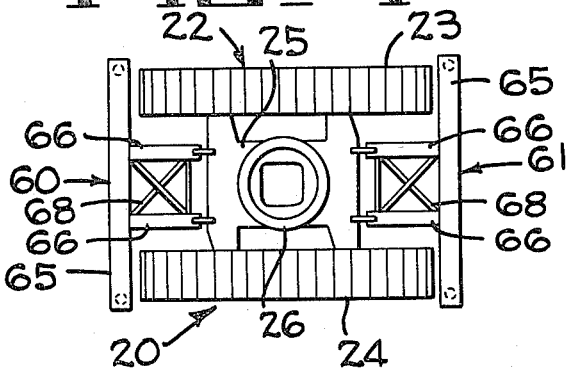
FIG. 4 is a diagrammatic plan of the lower portion of the arrangement of FIG. 3, the view being taken along line 4—4 of FIG. 3 with the upper members of the crane removed.

In FIGS. 3-5 the same crane 20 is illustrated equipped with outrigger units 60 and 61. Referring to FIG. 5, it will be seen that the two outriggers are identical only oriented to face in opposite directions, and that each unit includes an elongate beam 65 and two short beams 66 welded to and projecting away from beam 65 at right angles. A plurality of bracing rods 68 are interconnected between gusset plates 69 carried by the three beams. Each of the short beams 66 has a bifurcated end defined by spaced plates 70 and 71 which receive between them a pair of flanges 72 and 73 (FIG. 6) that projects outwardly from the transverse body member 25 of the lower frame. A large-headed pin 75 passes through aligned openings in each flange and the associated plates 70 and 71 to secure each of the outrigger units 60 and 61 to the body member 25 at four points. The elongate beam 65 of each of the outrigger supports is of box beam construction at its opposite ends and the casing of a hydraulic power cylinder 77 is mounted in the beam at each end between the side walls of the beam, the distance between the centers of the two cylinders being about 26 feet. As seen in FIG. 7, each cylinder has a piston rod 78 which extends downwardly from the casing of the cylinder and is provided with a fragmentary spherical surface 78*a* (FIG. 7) on its lower end. When the crane is being moved from place to place on the endless tracks 23 and 24, the lower end of the piston rod of each cylinder is in raised position spaced above the ground. When the load is to be lifted, the cylinder is energized to project the piston rods outwardly of the casings to move the lower end of each piston rod into engagement with a fragmentary spherical socket 79*a* of a steel plate 79 that is positioned on the ground below each power cylinder. Continued application of power by the cylinders causes the crane to be lifted off the ground. In this mode of operation, the crane has an increased lifting capacity when the distance between the two beams 65 of the outriggers is about 28'6" and the distance between the two power cylinders 77 on each beam is about 26'. The cylinder ends have spherical sockets and are supported by steel plates or cribbing.

Figures 8, 9:
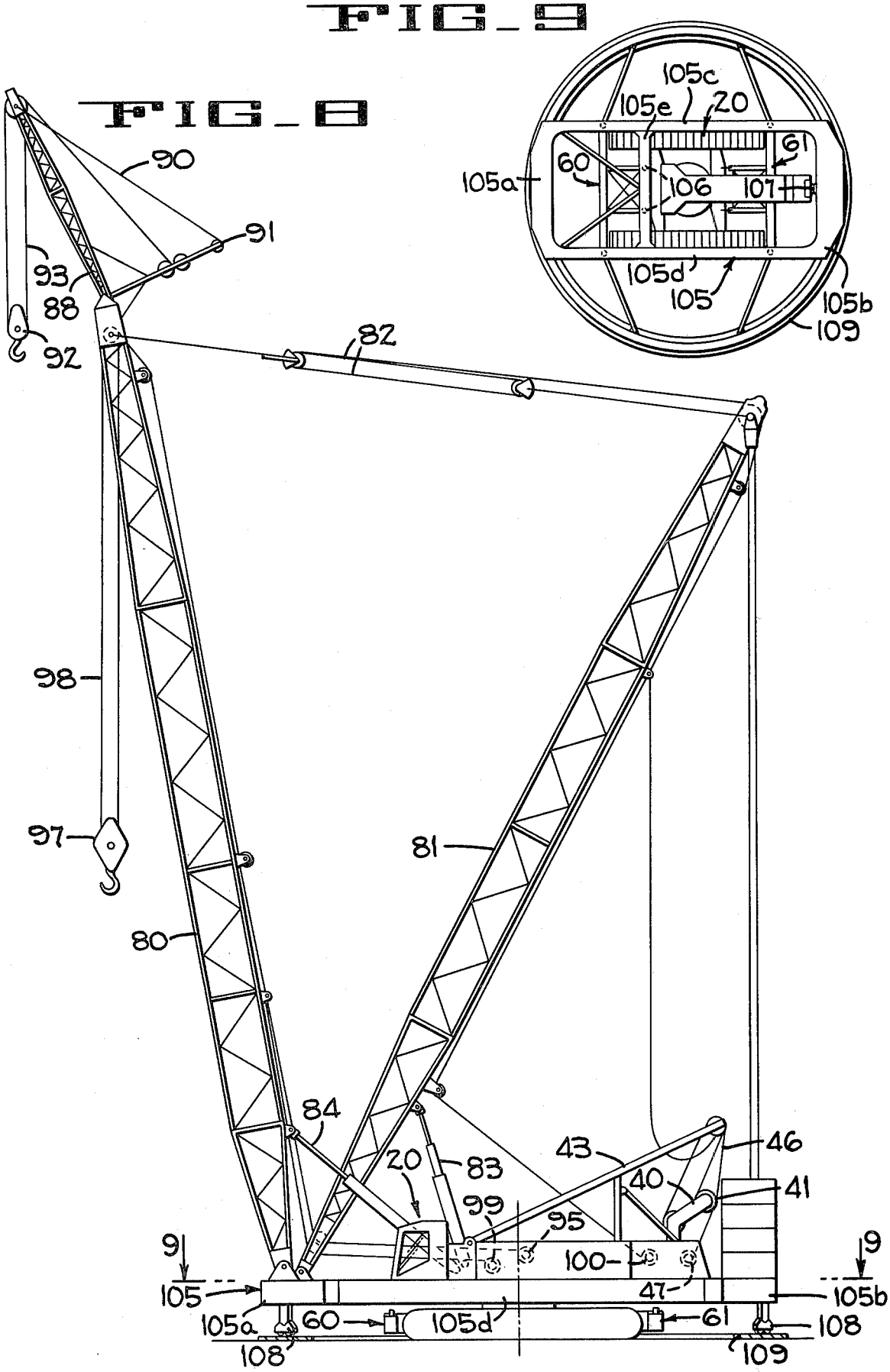
FIG. 8 is a diagrammatic side elevation of the crane of the present invention shown equipped with heavy duty lifting attachments.
FIG. 9 is a diagrammatic plan of the lower portion of the arrangement of FIG. 8, the view being taken along line 9—9 of FIG. 8 with the upper members of the crane removed.

In FIGS. 8 and 9 the arrangement of the crane 20 for heavy lift operation is illustrated. In this arrangement the superstructure and rigging includes a main boom 80, a gantry 81, reeving 82 for connecting the upper end of the main boom to the upper end of the gantry, a fixed gantry stop 83 for retaining the gantry in the illustrated position, and a telescoping boom stop 84 for limiting tbe rearward pivotal movement of the main boom. A jib boom 88 is pivoted to the upper end of the main boom 80, and is held at the desired angle by a pendant cable 90 and a jib mast 91. A jib block 92 and its load are raised or lowered by a cable 93 that has one end secured to the top of the jib boom, and is trained through the jib block and around several guide sheaves and the drum of a hoist 95. A block 97 on the main boom is raised and lowered by a cable 98 that has one end secured to the upper end of the main boom and is trained through the block 97 and around several guide sheaves and the drum of a second hoist 99. The main boom 80 is pivoted forwardly from the illustrated position (FIG. 8) by the reeving 82 which has its lower end connected to the hydraulically driven drum of a third hoist 100. The hoist 47 and the live mast 43 are operable through the cables 46 to raise the gantry 81 to its illustrated working position, or to control the lowering of the gantry to a horizontal position.

All of the above described components of the superstructure and rigging are well known in the art and have been described herein only to provide an understanding of the heavy duty crane mode of operation.

The details of the basic crane and the heavy duty arrangement are disclosed in the copending U.S. application of Wittman et al Ser. No. 138,461 filed on Apr. 8, 1980 (now U.S. Pat. No. 4,394,911) and assigned to the assignee of the present application which is included by reference and made a part of the present application. In general, when the crane is in a heavy duty mode, it is provided with an auxiliary frame 105 (FIG. 9) which includes a foot section 105*a*, a counterweight support section 105*b*, two side beams 105*c* and 105*d* and a transverse beam 105*e* all integrally connected. The gantry 81 is held firmly against the gantry stop 83 in operative position by pendants connected between the top of the gantry 81 and the counter-weight support section 105*b* of the auxiliary frame 105, and extends between counterweights supported on section 105*b*. As explained in the above-mentioned Wittman et al application, the transverse beam 105*e* is provided with two transversely spaced sets of arms, each set including two vertically spaced arms that are connected by a vertically disposed pin 106 to similar spaced arms projecting outwardly from the forward wall of the upper works. Similarly, the rear wall of the upper works is pinned at 107 to spaced tabs projecting forwardly from the counterweight support section 105*b* of the auxiliary frame. The vertical clearance between the ears of the connected members is such that the entire auxiliary frame can move vertically relative to the upper frame for a distance of about 18". The auxiliary frame also carries depending wheel units 108 at each end and, during a lifting operation, these wheels engage a circular steel ring 109 that is positioned on the ground.

In accordance with the present invention, when the crane is arranged for heavy duty service, each of the outrigger units 60 and 61 is disconnected from the lower frame, rotated 180° about a horizontal axis, and reconnected to the lower frame. As seen in FIG. 8, this will orient the piston rods of the power cylinders in an upwardly projecting position. Then, when the power cylinders are energized, the fragmentary spherical ends of the piston rods will engage the underside of the side frame members 105*c* and 105*d* to raise the auxiliary frame through the above-mentioned 18" relative to the upper works.

The manner in which the outriggers are disconnected from the lower frame is clearly shown in FIGS. 5 and 6 and involves the withdrawal of the pin 75 from each joint, the turning over of the outrigger, and the re-pinning of the outrigger to the lower frame. When the crane is arranged as shown in FIG. 8, it is capable of lifting a load of 700 tons.

From the foregoing description, it will be seen that the present invention provides a unique means of mounting an outrigger so that it can not only act as a stabilizing unit but can alternatively act as a lifting mechanism that makes possible a lifting operation in a heavy lift range.

What is claimed is:

1. An apparatus including a basic crane with load lifting means on an upper works that is supported on a longitudinally extending lower works for rotation about a vertical axis, said basic crane components including power means for propelling the basic crane to different locations for rotating said upper works about said vertical axis and for selectively lifting loads of substantially different magnitudes between two locations; said apparatus additionally comprising means defining a pair of outriggers, removable connecting means, means defining a plurality of jack means, movable lifting elements on each of said jack means, an auxiliary frame, means defining rigid annular ground supporting surfaces, wheel means depending from said auxiliary frame, a gantry, a counterweight, power operated reeving, pendant means, and additional power means:

when handling a light load said apparatus comprising only said basic crane;

when handling an intermediate load which is too heavy to be lifted and transferred between two locations by said basic crane, said apparatus comprising;

said basic crane, said means defining a pair of outriggers, said removable connecting means connecting said outriggers to said lower works with the outriggers extending transversely of said lower works, said jack means secured to each end of each of said outriggers, said movable lifting elements being directed downwardly from said outriggers for supporting the intermediate load and at least a substantial portion of said basic crane;

when handling a heavy load which is too heavy to be lifted and transferred between two locations by said basic crane and said outriggers including said downwardly extending lifting elements, said apparatus comprising;

said basic crane, said outriggers with said lifting elements reversed and extending upwardly, said auxiliary frame encompassing said upper works and mounted for rotation with said upper works about said vertical axis and mounted for vertical movement relative to said upper works, said means defining a rigid annular ground supported surface being positioned below end portions of said auxiliary frame, said wheel means being in position to support said auxiliary frame for rotation about said vertical axis, said gantry and said boom being pivotally mounted on one end of said auxiliary frame, said counterweight being supported on the other end of said frame, said power operated reeving interconnecting the boom and gantry for varying the operating angle of said boom, said pendant means attaching said gantry to said auxiliary frame, said additional power means attaching said boom to the upper end of said gantry and cooperating with said power means for first lifting and carrying the heavy load between two locations, said upwardly directed lifting elements when extended being effective to engage and lift said auxiliary frame and component supported thereon a sufficient distance above said rigid annular surface for moving said basic crane and components supported thereon to a different location.

2. An apparatus according to claim 1 wherein said light load is up to about 400 tons, said intermediate load is between about 400 to 500 tons, and said heavy load is between about 500 to 700 tons.

3. An apparatus according to claim 1 wherein the transverse distance between the two lifting elements on each outrigger is about 26 feet and the longitudinal distance between each pair of outriggers is about 28½ feet.

4. An apparatus according to claim 1 wherein said movable lifting elements of said jack means are moved between the downwardly directed position and said upwardly directed position by removing said movable connecting means, inverting each of said outriggers and reconnecting said outriggers to said lower works by reinserting said removable connecting means.

5. An apparatus according to claim 1 wherein each of said jack means are hydraulic power cylinders and wherein said movable lifting elements are piston rods of said cylinders.

* * * * *